US009603212B2

(12) United States Patent
Choi et al.

(10) Patent No.: US 9,603,212 B2
(45) Date of Patent: Mar. 21, 2017

(54) AC-DRIVEN LED LIGHTING APPARATUS WITH MULTI-CELL LED

(71) Applicant: Seoul Semiconductor Co., Ltd., Ansan-si (KR)

(72) Inventors: Jae Young Choi, Ansan-si (KR); Kwang Bea Lim, Ansan-si (KR); Jong Kook Lee, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 14/640,343

(22) Filed: Mar. 6, 2015

(65) Prior Publication Data

US 2015/0264764 A1 Sep. 17, 2015

Related U.S. Application Data

(60) Provisional application No. 61/951,116, filed on Mar. 11, 2014.

(51) Int. Cl.
*H05B 33/08* (2006.01)

(52) U.S. Cl.
CPC ..... *H05B 33/083* (2013.01); *H05B 33/0803* (2013.01)

(58) Field of Classification Search
CPC . H01L 2224/48091; H01L 2924/00014; H01L 33/62; H05B 33/0818; H05B 33/083
See application file for complete search history.

(56) References Cited

U.S. PATENT DOCUMENTS

| | | | | |
|---|---|---|---|---|
| 2002/0080622 | A1 | 6/2002 | Pashley et al. | |
| 2008/0179602 | A1 | 7/2008 | Negley et al. | |
| 2012/0051045 | A1* | 3/2012 | Harbers | F21K 9/56 362/235 |
| 2012/0068198 | A1 | 3/2012 | Andrews et al. | |
| 2013/0026931 | A1* | 1/2013 | Jong | H05B 33/0818 315/186 |

OTHER PUBLICATIONS

Allegro Microsystems Inc., "RGB Multi Chip LED Modules, SEPM Series, 48101.001, Rev. 2", Published Dec. 31, 2008, pp. 1-14, Publisher: Allegro MicroSystems, Worcester, MA.

* cited by examiner

*Primary Examiner* — Monica C King
(74) *Attorney, Agent, or Firm* — H.C. Park & Associates, PLC

(57) ABSTRACT

A light-emitting diode (LED) lighting apparatus includes a rectification unit connected to an alternating current (AC) power source, and an LED light emitting module including m multi-cell LEDs each having n light emitting cells, $k^{th}$ light emitting cells of the respective m multi-cell LEDs being connected to each other in series to form a $k^{th}$ light emitting cell group, n being a positive integer of 2 or greater, m being a positive integer of 1 or greater, and k being a positive integer from 1 to n. The rectification unit is configured to supply a rectified voltage to the LED light emitting module through full-wave rectification of an AC voltage from the AC power source. The LED light emitting module is configured to emit light upon receiving the rectified voltage from the rectification unit, and to control sequential driving of first to $n^{th}$ light emitting cell groups according to a voltage level of the rectified voltage.

7 Claims, 6 Drawing Sheets

AC-DRIVEN LED LIGHTING APPARATUS WITH MULTI-CELL LED

CROSS-REFERENCE TO RELATED APPLICATION

This application claims priority from and the benefit of U.S. Provisional Application No. 61/951,116, filed on Mar. 11, 2014, which is hereby incorporated by reference for all purposes as if fully set forth herein.

BACKGROUND

Field

The present invention relates to an AC-driven LED lighting apparatus using a multi-cell LED. More particularly, the present invention relates to an AC-driven LED lighting apparatus using a multi-cell LED, in which the multi-cell LED is configured to allow a plurality of light emitting cells included in the multi-cell LED to be independently controlled and the light emitting cells in the multi-cell LED can be sequentially driven under control of an LED driving module.

Description of the Background

Generally, a light emitting diode (LED) can be driven only by DC power due to inherent characteristics thereof. As a result, a lighting apparatus employing such a conventional LED is limited in applicability and requires a separate circuit such as an SMPS when used in domestic settings employing AC power, thereby complicating circuit design of a lighting apparatus while increasing manufacturing costs To solve such problems, various studies have focused on development of an AC-driven LED lighting apparatus which can be driven by AC power.

FIG. 1 is a block diagram of a conventional AC-driven LED lighting apparatus using LEDs and FIG. 2 is a waveform diagram of rectified voltage and LED drive current of the conventional AC-driven LED lighting apparatus shown in FIG. 1.

As shown in FIG. 1, the conventional AC-driven LED lighting apparatus may include an LED light emitting module composed of a plurality of LEDs 20 and an LED driving module 10. The LED driving module 10 supplies a rectified voltage Vrec to the LED light emitting module through full-wave rectification of AC voltage received from an AC power source, and is configured to control sequential driving of a first LED group 30, a second LED group 40, a third LED group 50 and a fourth LED group 60, which constitute the LED light emitting module, according to a volume level of the rectified voltage Vrec.

In addition, the LED light emitting module is composed of the first LED group 30, the second LED group 40, the third LED group 50 and the fourth LED group 60, each of which includes a plurality of LEDs 20, in which the first to fourth LED groups 30 to 60 are sequentially driven by control of the LED driving module 10. Here, the LEDs 20 constituting each of the LED groups are typical LEDs and configured to be entirely turned on or off regardless of whether the LEDs are single-cell LEDs each including a single cell therein or MJL LEDs each including a plurality of cells therein.

Referring to FIG. 2, in operation of the conventional AC LED lighting apparatus as described above, the LED driving module 10 determines the voltage level of the rectified voltage Vrec and sequentially drives the first LED group 30, the second LED group 40, the third LED group 50 and the fourth LED group 60 according to the determined voltage level of the rectified voltage Vrec.

Accordingly, the LED driving module 10 controls only the first LED group 30 to be turned on, when the voltage level of the rectified voltage Vrec reaches a first forward voltage level Vf1.

In addition, when the voltage level of the rectified voltage Vrec is increased and reaches a second forward voltage level Vf2, the LED driving module 10 controls only the first LED group 30 and the second LED group 40 to be turned on.

Further, when the voltage level of the rectified voltage Vrec is increased and reaches a third forward voltage level Vf3, the LED driving module 10 controls the first LED group 30, the second LED group 40 and the third LED group 50 to be turned on, and similarly, when the voltage level of the rectified voltage Vrec reaches a fourth forward voltage level Vf4, the LED driving module 10 controls all of the first to fourth LED groups 30 to 60 to be turned on.

Likewise, when the voltage level of the rectified voltage Vrec is decreased to less than the fourth forward voltage level Vf4 after reaching a peak voltage level, the LED driving module 10 turns off the fourth LED group 60. Then, when the voltage level of the rectified voltage Vrec is decreased to less than the third forward voltage level Vf3, the LED driving module 10 turns off the third LED group 50; when the voltage level of the rectified voltage Vrec is decreased to less than the second forward voltage level Vf2, the LED driving module 10 turns off the second LED group 40; and when the voltage level of the rectified voltage Vrec is decreased to less than the first forward voltage level Vf1, the LED driving module 10 turns off the first LED group 30.

Since the first to fourth LED groups 30 to 60 are sequentially driven, such a conventional AC-driven LED lighting apparatus suffers brightness deviation according to locations of the LED groups. Moreover, in the conventional AC-driven LED lighting apparatus, the LEDs 20 of the first to fourth LED groups 30 to 60 are driven in different sections according to the LED groups to which the corresponding LEDs 20 pertain, thereby causing deviation in luminous flux and on/off-period between the LEDs 20.

SUMMARY

The present invention has been conceived to solve the aforementioned problems in the related art.

It is an object of the present invention to provide a multi-cell LED configured to allow a plurality of light emitting cells included in the multi-cell LED to be independently controlled.

It is another object of the present invention to provide an LED driving module that can sequentially drive the plurality of light emitting cells in the multi-cell LED as set forth above.

It is a further object of the present invention to provide an AC-driven LED lighting apparatus using a multi-cell LED, in which the multi-cell LED is configured to allow a plurality of light emitting cells included in the multi-cell LED to be independently controlled and the light emitting cells can be sequentially driven under control of an LED driving module.

The above and other objects, and the following advantageous effects of the present invention can be achieved by features of the present invention, which will be described hereinafter.

In accordance with one aspect of the invention, there is provided an LED lighting apparatus, which includes: a rectification unit connected to an AC power source and supplying a rectified voltage to the LED light emitting module through full-wave rectification of AC voltage supplied from the AC power source; an LED light emitting module including m multi-cell LEDs each including n light emitting cells, the LED light emitting module emitting light upon receiving the rectified voltage from the rectification unit, kth light emitting cells of the respective m multi-cell LEDs being connected to each other in series to form a kth light emitting cell group (n being a positive integer of 2 or more, m being a positive integer of 1 or higher, and k being a positive integer from 1 to n); and an LED light emitting module controlling sequential driving of first to nth light emitting cell groups according to a voltage level of the rectified voltage.

The LED driving module may control sequential driving of the first light emitting cell group to the nth light emitting cell group by controlling formation of a current path from the first light emitting cell group to the nth light emitting cell group according to the voltage level of the rectified voltage.

Each of the multi-cell LEDs may include: first to nth light emitting cells electrically connected to each other; first to nth light emitting cells electrically connected to each other; first to nth terminals for anode external connection connected to anodes of the first to nth light emitting cells, respectively; and first to nth terminals for cathode external connection connected to cathodes of the first to nth light emitting cells, respectively.

The first to nth light emitting cells in each of the multi-cell LEDs may have different sizes.

The sizes of the first to nth light emitting cells in each of the multi-cell LEDs may be determined according to a power deviation rate in each sequential driving stage.

The sizes of the first to nth light emitting cells in each of the multi-cell LEDs may be determined based on a light emitting duration in one cycle of the rectified voltage.

The LED driving module may perform dimming control by adjusting a maximum voltage level of the rectified voltage to be supplied to the LED light emitting module according to a selected dimming level.

As described above, according to the present invention, an effect of independently controlling driving of a plurality of light emitting cells included in a multi-cell LED can be achieved.

In addition, according to the present invention, an effect of allowing sequential driving of plural light emitting cells included in a multi-cell LED can be achieved.

Further, according to the present invention, an effect of removing deviation in luminous flux and on/off period between plural multi-cell LEDs constituting an LED light emitting module can be achieved by sequentially driving light emitting cells in each of the multi-cell LEDs.

Furthermore, according to the present invention, an effect of removing brightness deviation of the LED lighting apparatus can be achieved by allowing at least one light emitting cell in each of the plural multi-cell LEDs constituting the LED light emitting module to emit light even in a first-stage sequential driving operation.

BRIEF DESCRIPTION OF THE DRAWINGS

The above and other aspects, features, and advantages of the present invention will become apparent from the detailed description of the following embodiments in conjunction with the accompanying drawings, in which.

DETAILED DESCRIPTION OF THE ILLUSTRATED EMBODIMENTS

Figure 1:
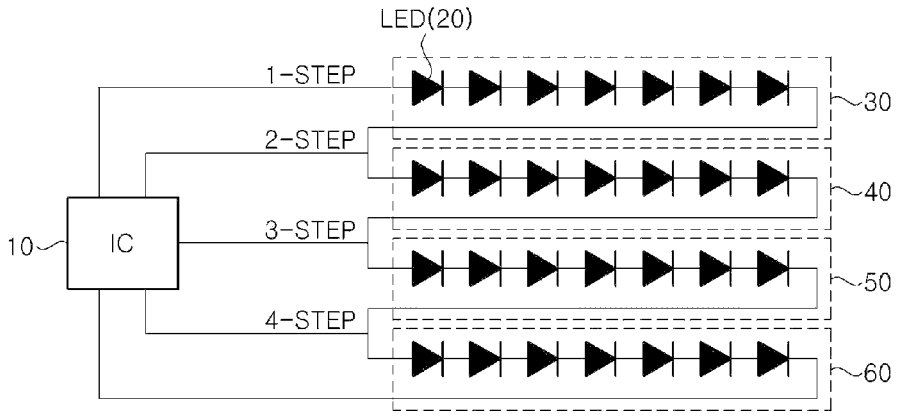
FIG. 1 is a schematic block diagram of a conventional AC-driven LED lighting apparatus using LEDs.
Figure 2:
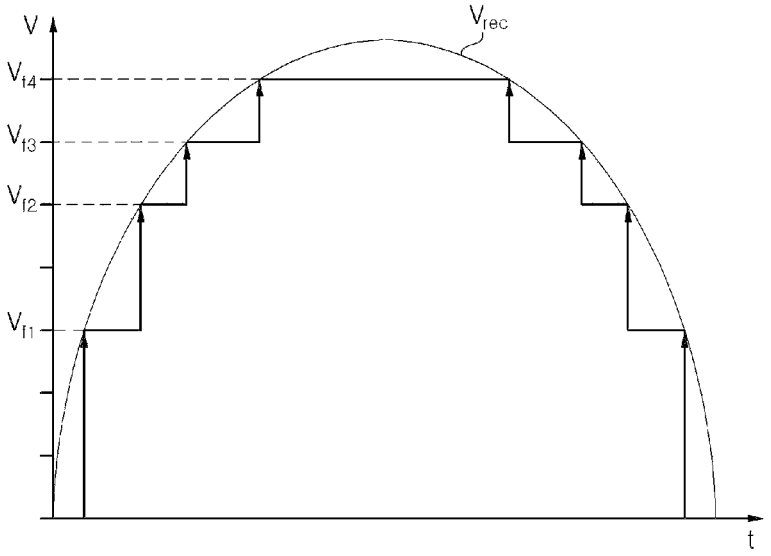
FIG. 2 is a waveform diagram of rectified voltage and LED drive current of the conventional AC-driven LED lighting apparatus shown in FIG. 1.

The present invention will be described more fully hereinafter with reference to the accompanying drawings, in which exemplary embodiments of the invention are illustrated. These embodiments will be described such that the invention can be easily realized by those skilled in the art. Here, although various embodiments are disclosed herein, it should be understood that these embodiments are not intended to be exclusive. For example, individual structures, elements or features of a particular embodiment are not limited to that particular embodiment and can be applied to other embodiments without departing from the spirit and scope of the invention. In addition, it should be understood that locations or arrangement of individual components in each of the embodiments may be changed without departing from the spirit and scope of the present invention. Therefore, the following embodiments are not to be construed as limiting the invention, and the present invention should be limited only by the claims and equivalents thereof. Like components having the same or similar functions will be denoted by like reference numerals.

Hereinafter, exemplary embodiments of the invention will be described in detail with reference to the accompanying drawings so as to be easily realized by those skilled in the art to which the present invention pertains.

As used herein, the term "multi-cell LED" means a light emitting diode (LED) that includes a plurality of light emitting cells, each of which is not electrically connected to other light emitting cells within the multi-cell LED and is provided with terminals for external connection (a terminal for anode external connection and a terminal for cathode external connection). Although the number of light emitting cells included in each multi-cell LED can be set in various ways as needed, for convenience of description and understanding, the following description will provide exemplary embodiments in which one multi-cell LED includes first to fourth light emitting cells, that is, four light emitting cells.

In addition, the term "light emitting cell group" means a group of certain light emitting cells connected to each other in series in each of multi-cell LEDs in exemplary embodiments, in which an LED light emitting module is composed of a plurality of multi-cell LEDs and each light emitting cell group is turned on and turned off at the same time as a single unit under control of an LED driving module. Specifically, a first light emitting cell group means a light emitting cell group in which first light emitting cells of the respective multi-cell LEDs are connected to each other in series, and a second light emitting cell group means a light emitting cell group in which second light emitting cells of the respective multi-cell LEDs are connected to each other in series. Likewise, an nth light emitting cell group means a light emitting cell group in which nth light emitting cells of the respective multi-cell LEDs are connected to each other in series.

Further, the term "first forward voltage level Vf1" means a critical voltage level capable of driving the first light emitting cells in the entirety of the multi-cell LEDs constituting the LED light emitting module, that is, a critical voltage level capable of driving the first light emitting cell group, and the term "second forward voltage level Vf1" means a critical voltage level capable of driving the first light emitting cells and second light emitting cells in the entirety of the multi-cell LEDs connected to each other and constituting the LED light emitting module, that is, a critical voltage level capable of driving the first light emitting cell group and the second light emitting cell group. Accordingly, the term "nth forward voltage level Vfn" means a critical voltage level capable of driving the first to nth LED light emitting cells in the entirety of the multi-cell LEDs constituting the LED light emitting module, that is, a critical voltage level capable of driving the first to nth light emitting cell groups.

Furthermore, the term "LED driving module" means a module that drives and controls light emitting cells in the multi-cell LED upon receiving AC voltage and will be described as a driving module that controls driving of the multi-cell LED using a rectified voltage in the following exemplary embodiments. However, it should be understood that the present invention is not limited thereto and this term should be interpreted in a comprehensive and broad way.

Furthermore, the term "sequential driving" means a process of sequentially turning on the plurality of light emitting cells (the first to nth light emitting cell groups) in the multi-cell LED by the LED driving module, which drives the multi-cell LED upon receiving an input voltage varying over time, to emit light as the input voltage applied to the LED driving module increases, while sequentially turning off the plurality of LED groups (the first to nth light emitting cell groups) in the multi-cell LED as the input voltage applied to the LED module decreases.

Figure 3:
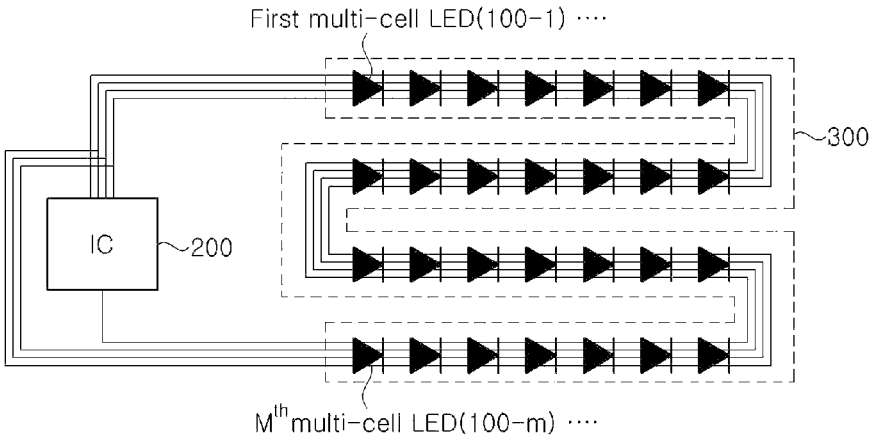
FIG. 3 is a schematic block diagram of an AC-driven LED lighting apparatus using a multi-cell LED according to one exemplary embodiment of the present invention.

FIG. 3 is a schematic block diagram of an AC-driven LED lighting apparatus using a multi-cell LED according to one exemplary embodiment of the present invention. Referring to FIG. 3, the configuration and functions of the AC-driven LED lighting apparatus using a multi-cell LED according to one exemplary embodiment of the invention will be described in brief.

The AC-driven LED lighting apparatus according to the exemplary embodiment of the invention may include an LED light emitting module that includes an LED driving module 200 and a plurality of multi-cell LEDs 100.

According to the exemplary embodiment, the LED driving module 200 is configured to supply a rectified voltage Vrec to the LED light emitting module through full-wave rectification of AC voltage received from an AC power source, and to control sequential driving of a plurality of light emitting cells (that is, the first to nth light emitting cell groups) in each of plural multi-cell LEDs 100 constituting the LED light emitting module depending upon a voltage level of the rectified voltage Vrec.

Figure 4:
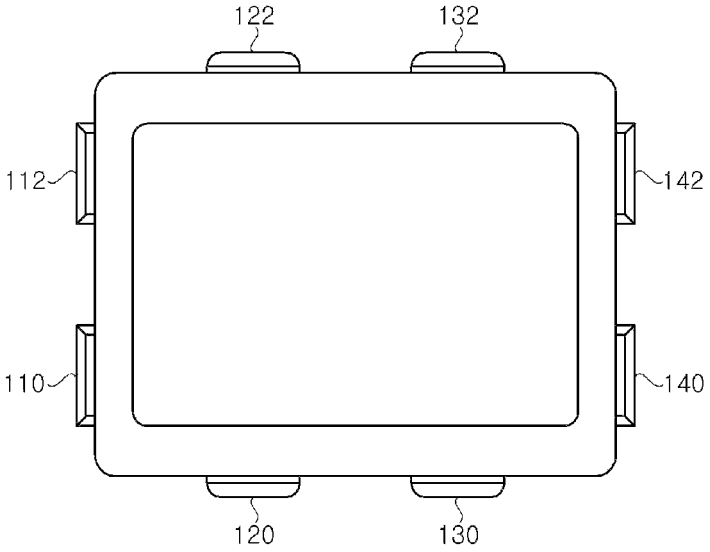
FIG. 4 is a plan view of a multi-cell LED according to one exemplary embodiment of the present invention.
Figure 5:
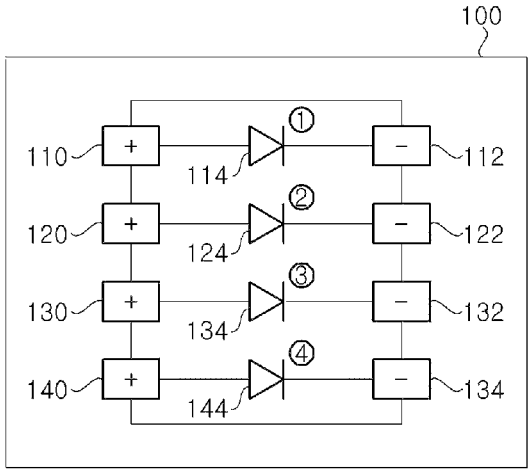
FIG. 5 is a circuit diagram of the multi-cell LED shown in FIG. 4.
Figure 6:
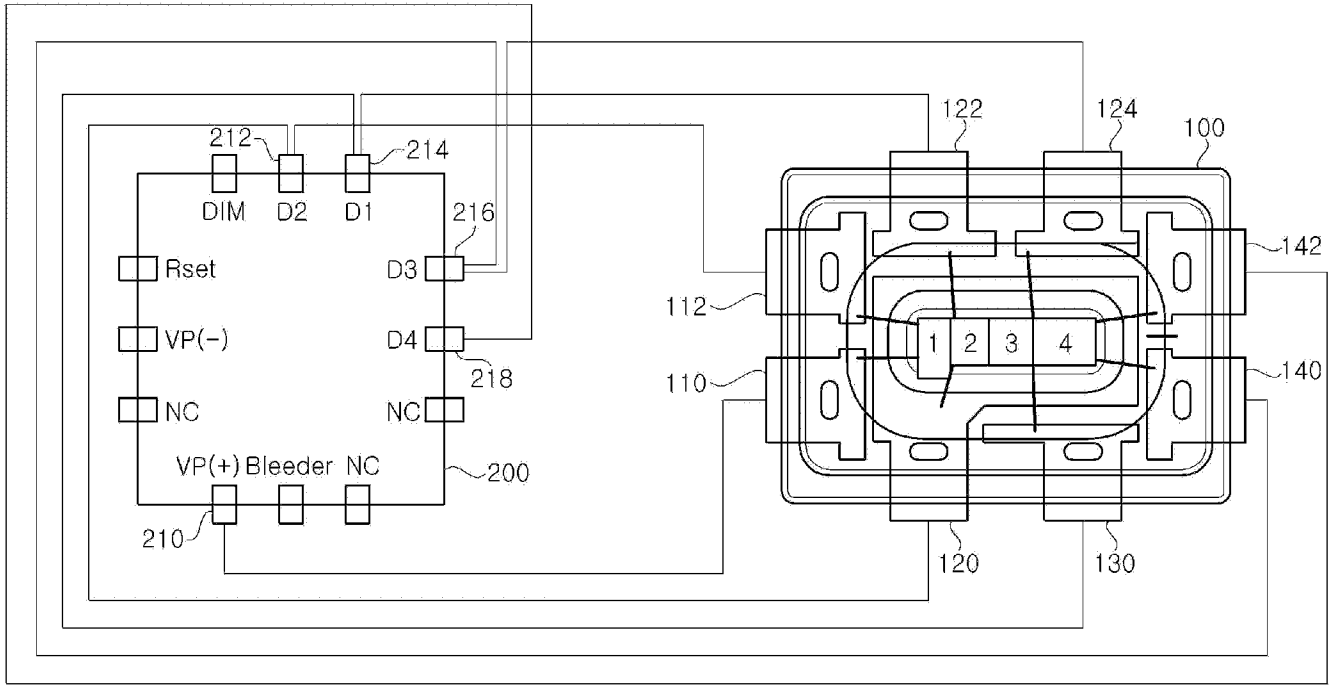
FIG. 6 is a circuit diagram of an AC-driven LED lighting apparatus using a multi-cell LED according to one exemplary embodiment of the present invention.

According to one exemplary embodiment, the LED light emitting module 300 may include m multi-cell LEDs 100-1 to **100-*m* (m being a positive integer of 1 or more). In addition, each of the multi-cell LEDs 100 may include n light emitting cells (n being a positive integer of 2 or more). Although the number of light emitting cell units included in each of the multi-cell LEDs can be set in various ways as needed, for convenience of description and understanding, the following description will provide exemplary embodiments in which each of the multi-cell LEDs includes four light emitting cells and the LED driving module 200 is configured to perform four-stage sequential driving, as shown in FIGS. 4 to 6**.

In FIG. 3, first light emitting cells of the respective multi-cell LEDs 100 are connected in series to the LED driving module 200, thereby forming a first light emitting cell group in which m first light emitting cells are connected to each other in series. That is, the first light emitting cell group is configured such that the first light emitting cells of a first multi-cell LED 100-1 to an nth multi-cell LED **100-*m* are connected to each other in series, an anode of the first light emitting cell of the first multi-cell LED 100-1 is connected to the LED driving module 200, and a cathode of the first light emitting cell of the mth multi-cell LED 100-*m* is connected to the LED driving module 200. Likewise, second light emitting cells of the respective m multi-cell LEDs 100 may be connected in series to the LED driving module 200 to form a second light emitting cell group; third light emitting cells of the respective m multi-cell LEDs 100 may be connected in series to the LED driving module 200 to form a third light emitting cell group; and fourth light emitting cells of the respective m multi-cell LEDs 100 may be connected in series to the LED driving module 200 to form a fourth light emitting cell group. For the LED lighting apparatus with the structure as described above, in a section in which the voltage level of the rectified voltage Vrec is higher than or equal to the first forward voltage level Vf1 and less than the second forward voltage level Vf2 (first stage driving section), the first light emitting cells of the first multi-cell LED 100-1 to the mth multi-cell LED 100-*m* (that is, the first light emitting cell group) are driven. Likewise, in a section in which the voltage level of the rectified voltage Vrec is higher than or equal to the second forward voltage level Vf2 and less than the third forward voltage level Vf3 (second stage driving section), sequential driving is controlled such that the first light emitting cells and the second light emitting cells of the first multi-cell LED 100 to the mth multi-cell LED 100 (that is, the first light emitting cell group and the second light emitting cell group) are driven. Likewise, in a section in which the voltage level of the rectified voltage Vrec is higher than or equal to the third forward voltage level Vf3 and less than the fourth forward voltage level Vf4 (third stage driving section), sequential driving is controlled such that the first light emitting cells, the second light emitting cells, and the third light emitting cells of the first multi-cell LED 100 to the nth multi-cell LED 100 (that is, the first to third light emitting cell groups) are driven; and in a section in which the voltage level of the rectified voltage Vrec is higher than or equal to the fourth forward voltage level Vf4 (fourth stage driving section), sequential driving is controlled such that all of the first to fourth light emitting cells of the first multi-cell LED 100-1 to the mth multi-cell LED 100 (that is, the first to fourth light emitting cell groups) are driven. That is, sequential driving is performed such that the first light emitting cell group composed of the first light emitting cells of the m multi-cell LEDs 100 is driven in the first stage driving section; the first light emitting cell group composed of the first light emitting cells of the m multi-cell LEDs 100 and the second light emitting cell group composed of the second light emitting cells of the m multi-cell LEDs 100 are driven in the second stage driving section; the first light emitting cell group to the third light emitting cell group respectively composed of the first light emitting cells to the third light emitting cells of the m multi-cell LEDs 100 are driven in the third stage driving section; and all of the first light emitting cell group to the fourth light emitting cell group respectively composed of the first light emitting cells to the fourth light emitting cells of the m multi-cell LEDs 100** are driven in the fourth stage driving section.

Furthermore, in another exemplary embodiment, wherein n is not 4, for example, n=3, that is, each of the multi-cell LEDs 100 includes three light emitting cells, the LED lighting apparatus performs three-stage sequential driving of first to third light emitting cell groups. In an alternative exemplary embodiment, wherein n=5, that is, each of the multi-cell LEDs 100 includes five light emitting cells, the LED lighting apparatus performs five-stage sequential driving of first to fifth light emitting cell groups. That is, in the LED lighting apparatus according to the present invention, it should be noted that the light emitting cell groups are provided corresponding to the number of light emitting cells included in each of the multi-cell LEDs 100 and multi-stage driving is performed for each of the light emitting cell groups.

It should be understood that the present invention is not limited to the aforementioned configuration of the LED light emitting module. In an alternative exemplary embodiment of the invention, the first to fourth light emitting cells of each of the plural multi-cell LEDs 100 may be independently connected to the LED driving module 200. In this exemplary embodiment, the first to fourth light emitting cells of each of the multi-cell LEDs 100 may be independently controlled. Thus, the first forward voltage level may mean a critical voltage level capable of driving the first light emitting cell in one multi-cell LED 100, and the second forward voltage level may mean a critical voltage level capable of driving the first and second light emitting cells in one multi-cell LED 100. Likewise, the fourth forward voltage level may mean a critical voltage level capable of driving the first to fourth light emitting cells in one multi-cell LED 100.

It is noted that the LED driving module 200 according to the present invention is configured to control sequential driving of the plural light emitting cells in each of the m multi-cell LEDs 100 constituting the LED light emitting module, instead of controlling sequential driving of the plurality of LED groups each including a plurality of LEDs. Such characteristics of the present invention are based on the provision of the multi-cell LED 100 that allows the plurality of light emitting cells included in the multi-cell LED 100 to be independently controlled.

FIG. 4 is a plan view of a multi-cell LED according to one exemplary embodiment of the present invention and FIG. 5 is a circuit diagram of the multi-cell LED shown in FIG. 4. Hereinafter, a multi-cell LED 100 according to one exemplary embodiment of the invention will be described with reference to FIG. 4 and FIG. 5.

Referring to FIG. 4 and FIG. 5, the multi-cell LED 100 according to the exemplary embodiment may include a first light emitting cell 114, a second light emitting cell 124, a third light emitting cell 134, a fourth light emitting cell 144, a first external connection terminal (first terminal for anode external connection) 110 and a second external terminal connection (for terminal for cathode external connection) 112 configured to connect the first light emitting cell 114 to the outside, a third external connection terminal (second terminal for anode external connection) 120 and a fourth external terminal connection (second terminal for cathode external connection) 122 configured to connect the second light emitting cell 124 to the outside, a fifth external connection terminal (third terminal for anode external connection) 130 and a sixth external terminal connection (third terminal for cathode external connection) 132 configured to connect the third light emitting cell 134 to the outside, and a seventh external connection terminal (fourth terminal for anode external connection) 140 and an eleventh external terminal connection (fourth terminal for cathode external connection) 142 configured to connect the fourth light emitting cell 144 to the outside. As shown therein, the first light emitting cell 114, the second light emitting cell 124, the third light emitting cell 134, and the fourth light emitting cell 144 are electrically insulated from each other within the multi-cell LED 100, and each may be electrically connected to two terminals for external connection. Thus, driving of the light emitting cells may be independently controlled using two terminals for external connection which are connected to each of the light emitting cells.

On the other hand, the size of each of the light emitting cells and/or the number of light emitting cells constituting each of the light emitting cells may differ according to embodiments as needed. That is, since power output of the light emitting cells varies (for example, the first light emitting cell 114 outputs 100% power, the second light emitting cell 124 outputs 92% power, the third light emitting cell 134 outputs 77% power, and the fourth light emitting cell 144 outputs 56% power) due to sequential driving of the light emitting cells, the size of each of the light emitting cells may be differently set depending upon a power deviation rate of each sequential driving stage to suppress deviation in luminous flux between the light emitting cells. In an alternative embodiment, the size of each of the light emitting cells may be determined based on a period of time for each of the light emitting cells to emit light in one cycle of the rectified voltage Vrec. For example, the light emitting cells may be designed to have a large size with increasing period of time for the light emitting cells to emit light in one cycle of the rectified voltage Vrec. In an exemplary embodiment wherein the first light emitting cell 114 to the fourth light emitting cell 144 are sequentially driven, the first light emitting cell 114 may have the largest area, the second light emitting cell 124 may have the second largest area, the third light emitting cell 134 may have the third largest area, and the fourth light emitting cell 144 may have the smallest area. That is, in the exemplary embodiment wherein the first light emitting cell 114 to the fourth light emitting cell 144 are sequentially driven, the sizes of the first to the fourth light emitting cells 114 to 144 may be determined to gradually decrease from the first light emitting cell 114 to the fourth light emitting cell 144.

The following Table 1 shows attributes of the multi-cell LED 100 according to the exemplary embodiment of the invention.

TABLE 1

| Subject | Unit | LED | Power deviation of each light emitting cell |
|---|---|---|---|
| Power consumption | W | 0.175 | First light emitting cell: 100%<br>Second light emitting cell: 92%<br>Third light emitting cell: 77%<br>Fourth light emitting cell: 56% |
| Luminous flux | lm | 25.389 | |
| Luminous efficacy | lm/W | 145.4 | |
| CCT | K | 5,000 | |
| CRI | (Ra) | 80↑ | |

TABLE 1-continued

| Subject | Unit | LED | Power deviation of each light emitting cell |
|---|---|---|---|
| Cost | $ | 0.06 | |
| Voltage (@1 cell) | V | 3.12 (3.12) | |
| Current(@1 cell) | mA | 64 (14) | |

Next, an AC-driven LED lighting apparatus employing such a multi-cell LED 100 according to one exemplary embodiment of the invention will be described.

FIG. 6 is a circuit diagram of an AC-driven LED lighting apparatus using a multi-cell LED according to one exemplary embodiment of the present invention. In the exemplary embodiment shown in FIG. 6, a single multi-cell LED 100 is connected to the LED driving module 200 for convenience of understanding and description. However, it will be apparent to those skilled in the art that the present invention is not limited thereto and m multi-cell LEDs 100 may be connected to the LED driving module 200 through a connection relationship as shown in FIG. 3.

As shown in FIG. 6, the LED driving module 200 according to the exemplary embodiment may include an LED voltage output terminal 210, a first control terminal 212, a second control terminal 214, a third control terminal 216, and a fourth control terminal 218. In addition, the multi-cell LED 100 may include a first light emitting cell 114, a second light emitting cell 124, a third light emitting cell 134, a fourth light emitting cell 144, a first terminal 110, a second terminal 112, a third terminal 120, a fourth terminal 122, a fifth terminal 130, a sixth terminal 132, a seventh terminal 140, and an eighth terminal 142. Although the first light emitting cell 114, the second light emitting cell 124, the third light emitting cell 134, and the fourth light emitting cell 144 are illustrated as being adjacent each other in the multi-cell LED 100, the light emitting cells may be electrically insulated from each other via an insulation layer (not shown) and the like.

More specifically, the LED voltage output terminal 210 is connected to the first terminal 110 of the multi-cell LED 100 in order to supply a rectified voltage Vrec generated by the LED driving module 200 as an LED driving voltage, and the first terminal 110 is connected to an anode of the first light emitting cell 114. Further, a cathode of the first light emitting cell 114 is connected to the second terminal 112, which is also connected to the first control terminal 212 of the LED driving module 200. Furthermore, the third terminal 120 connected to an anode of the second light emitting cell 124 of the multi-cell LED 100 is also connected to the first control terminal 212 of the LED driving module 200. Accordingly, the LED driving module 200 controls formation of a first current path of the LED driving voltage through the first control terminal 212 using an internal electronic switch (for example, a MOSFET) connected to the first control terminal 212.

Likewise, a cathode of the second light emitting cell 124 of the multi-cell LED 100 is connected to the fourth terminal 122, which is also connected to the second control terminal 214 of the LED driving module 200. Furthermore, the fifth terminal 130 connected to an anode of the third light emitting cell 134 of the multi-cell LED 100 is also connected to the second control terminal 214 of the LED driving module 200. Accordingly, the LED driving module 200 controls formation of a second current path of the LED driving voltage through the second control terminal 214.

Likewise, a cathode of the third light emitting cell 134 of the multi-cell LED 100 is connected to the sixth terminal 132, which is also connected to the third control terminal 216 of the LED driving module 200. Furthermore, the seventh terminal 140 connected to an anode of the fourth light emitting cell 144 of the multi-cell LED 100 is also connected to the third control terminal 216 of the LED driving module 200. Accordingly, the LED driving module 200 controls formation of a third current path of the LED driving voltage through the third control terminal 216.

Last, a cathode of the fourth light emitting cell 144 of the multi-cell LED 100 is connected to the eighth terminal 142, which is connected to the fourth control terminal 218 of the LED driving module 200. Accordingly, the LED driving module 200 controls formation of a fourth current path of the LED driving voltage through the fourth control terminal 218.

With the LED driving module 200 and the multi-cell LED 100 connected to each other through the connection relationship as described above, in the section in which the voltage level of the rectified voltage Vrec is higher than or equal to the first forward voltage level Vf1 and less than the second forward voltage level Vf2, the LED driving module 200 forms the first current path while opening the second to fourth current paths to control only the first light emitting cell 114 of the multi-cell LED 100 to emit light. Likewise, in the section in which the voltage level of the rectified voltage Vrec is higher than or equal to the second forward voltage level Vf2 and less than the third forward voltage level Vf3, the LED driving module 200 forms the second current path while opening the first current path, the third current path and the fourth current path to control the first light emitting cell 114 and the second light emitting cell 124 of the multi-cell LED 100 to emit light.

In addition, in the section in which the voltage level of the rectified voltage Vrec is higher than or equal to the third forward voltage level Vf3 and less than the fourth forward voltage level Vf4, the LED driving module 200 forms the third current path while opening the first current path, the second current path and the fourth current path to control the first to third light emitting cells 114 to 134 to emit light. Likewise, in the section in which the voltage level of the rectified voltage Vrec is higher than or equal to the fourth forward voltage level Vf4, the LED driving module 200 forms the fourth current path while opening the first to third current paths to control the first to fourth light emitting cells 114 to 144 of the multi-cell LED 100 to emit light.

On the other hand, as described above, in the exemplary embodiment of FIG. 6, a single multi-cell LED 100 is illustrated as being connected to the LED driving module 200 for convenience of description and understanding. Thus, in exemplary embodiments wherein the LED light emitting module includes a plurality of multi-cell LEDs 100, the connection relationship of the multi-cell LEDs 100 is provided as shown in FIG. 3. For example, assuming that the LED light emitting module includes two multi-cell LEDs 100. In this case, a second terminal 112 of a first multi-cell LED 100-1 connected to a cathode of a first light emitting cell 114 of the first multi-cell LED 100-1 is connected to a first terminal 110 of a second multi-cell LED 100 connected to an anode of a first light emitting cell 114 of the second multi-cell LED 100; and a second terminal 112 of the second multi-cell LED 100 connected to the anode of the first light emitting cell 114 of the second multi-cell LED 100 is connected to the first control terminal 212 of the LED driving module 200. The second to fourth light emitting cells 124 to 144 of the first multi-cell LED 100-1 and the second to fourth light emitting cells 124 to 144 of the second multi-cell LED 100 are connected to each other and to the LED driving module 200 in a similar manner.

On the other hand, in an alternative exemplary embodiment (in which each of multi-cell LEDs 100 includes n light emitting cells from a first light emitting cell 114 to an nth light emitting cell (not shown)), the AC-driven LED lighting apparatus may perform n-stage dimming control by adjusting a maximum voltage level of a rectified voltage Vrec to be supplied to an LED light emitting module 300 according to a selected dimming level even without a separate dimming circuit. As described above, the LED lighting apparatus according to the present invention is configured such that the light emitting cells in each of the multi-cell LEDs 100 constituting the LED light emitting module 300 are sequentially turned on and turned off according to the voltage level of the rectified voltage Vrec supplied to the LED light emitting module 300. Accordingly, in an exemplary embodiment of the invention in which the LED lighting apparatus performs n-stage sequential driving at a maximum dimming level (100% dimming level), when the maximum voltage level of the rectified voltage Vrec to be supplied to the LED light emitting module 300 is adjusted to be less than an nth forward voltage level Vfn, the LED light emitting module 300 provides reduced light output through first- to (n−1)th-stage driving in one cycle of the rectified voltage Vrec. Likewise, in this exemplary embodiment, when the maximum voltage level of the rectified voltage Vrec to be supplied to the LED light emitting module 300 is adjusted to be less than an (n−1)th forward voltage level Vfh−1, the LED light emitting module 300 provides further reduced light output through first- to (n−2)th-stage driving in one cycle of the rectified voltage. Thus, the LED lighting apparatus with the configuration as described above can perform n-stage dimming control through n-stage adjustment of the maximum voltage level of the rectified voltage Vrec to be supplied to the LED light emitting module 300 according to the selected dimming level. In order to perform the aforementioned dimming control function, the LED driving module 200 according to the present invention may be further configured to allow adjustment of the maximum voltage level of the rectified voltage Vrec to be supplied to the LED light emitting module 300 according to the selected dimming level. In other exemplary embodiments, such a dimming control function may be performed by a rectification unit (not shown) configured to output a rectified voltage Vrec and a separate dimmer (not shown) configured to adjust the maximum voltage level of the rectified voltage Vrec output from the rectification unit according to a selected dimming level.

Next, referring to FIG. 4 to FIG. 6, the aforementioned dimming control will be described in more detail with reference to an LED lighting apparatus capable of performing four-stage sequential driving and four-stage dimming control according to one exemplary embodiment of the invention. In this exemplary embodiment, assuming that the LED light emitting module 300 is configured to have a first forward voltage level Vf1 of 80V, a second forward voltage level Vf2 of 120V, a third forward voltage level Vf3 of 160V and a fourth forward voltage level Vf4 of 210V, and is configured such that the maximum voltage level of the rectified Vrec is adjusted to 90V in a first-stage dimming level (30% dimming level), 130V in a second-stage dimming level (60% dimming level), and 170V in a third-stage dimming level (80% dimming level), and the maximum voltage level of the rectified Vrec is not adjusted, that is, 220V, in a fourth-stage dimming level (100% dimming level). In this exemplary embodiment, when the selected dimming level is the fourth-stage dimming level, the LED driving module 200 does not adjust the maximum voltage level of the rectified Vrec to be supplied to the LED light emitting module 300, whereby the first to fourth light emitting cells 114 to 144 in each of the multi-cell LEDs 100 are sequentially driven in one cycle of the rectified voltage Vrec, thereby allowing the LED light emitting module 300 to maintain 100% light output. On the other hand, when the selected dimming level is the third-stage dimming level, the LED driving module 200 adjusts the maximum voltage level of the rectified Vrec to be supplied to the LED light emitting module 300 to 170V, whereby the first to third light emitting cells 114 to 134 in each of the multi-cell LEDs 100 are sequentially driven in one cycle of the rectified voltage Vrec, and the fourth light emitting cell 144 does not emit any light, thereby reducing the light output of the LED light emitting module 300 to, for example, 80%. Likewise, when the selected dimming level is the second-stage dimming level, the LED driving module 200 adjusts the maximum voltage level of the rectified Vrec to be supplied to the LED light emitting module 300 to 130V, whereby only the first and second light emitting cells 114, 124 in each of the multi-cell LEDs 100 are sequentially driven in one cycle of the rectified voltage Vrec, and the third and fourth light emitting cell 134, 144 do not emit any light, thereby reducing the light output of the LED light emitting module 300 to, for example, 60%. Likewise, when the selected dimming level is the first-stage dimming level, the LED driving module 200 adjusts the maximum voltage level of the rectified Vrec to be supplied to the LED light emitting module 300 to 90V, whereby only the first light emitting cell 114 in each of the multi-cell LEDs 100 is driven in one cycle of the rectified voltage Vrec, and the second to fourth light emitting cell 124, 134, 144 do not emit any light, thereby reducing the light output of the LED light emitting module 300 to, for example, 30%. As such, the LED lighting apparatus according to the present invention can perform dimming control of the LED light emitting module 300 without a separate dimming circuit by controlling the maximum voltage level of the rectified Vrec to be supplied to the LED light emitting module 300.

Figure 7A:
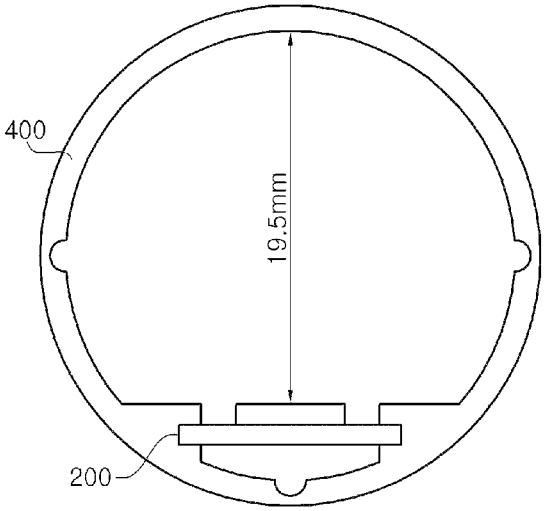
FIG. 7*a* to FIG. 7*c* are views of a tube type AC-driven LED lighting apparatus according to one exemplary embodiment of the present invention.
Figure 7B:
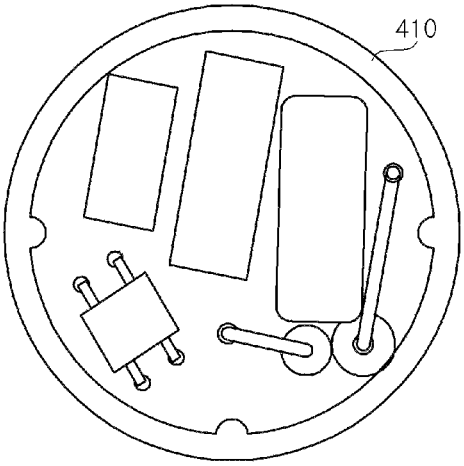
Figure 7C:
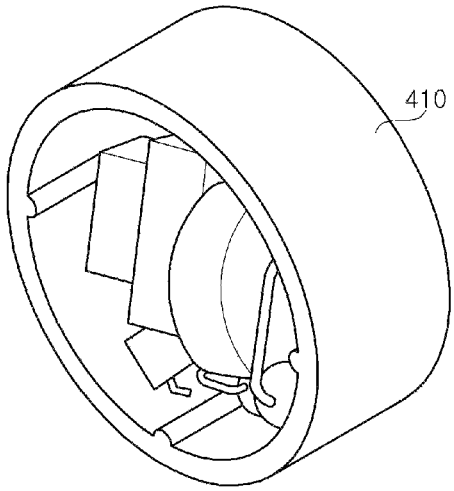

FIG. 7*a* to FIG. 7*c* are views of a tube type AC-driven LED lighting apparatus according to one exemplary embodiment of the present invention. As shown in FIG. 7*a*, the tube type AC-driven LED lighting apparatus according to this exemplary embodiment may include a diffusion tube 300. The diffusion tube 300 preferably has a transmittance of 86%.

In addition, as shown in FIGS. 7*b* and 7*c*, an SMPS circuit and protective circuits of the tube type AC-driven LED lighting apparatus may be disposed in a cap 310 of the LED lighting apparatus. Such configuration of the tube type AC-driven LED lighting apparatus can optimize use of an internal space of the tube such that a distance between an LED and the diffusion tube 300 can be maximized, thereby enabling removal of hot spot of the LED through expansion of a light mixing range.

What is claimed is:

1. A light-emitting diode (LED) lighting apparatus, comprising:

a rectification unit connected to an alternating current (AC) power source; and an LED light emitting module comprising m multi-cell LEDs each comprising n light emitting cells, n being a positive integer of 2 or greater, and m being a positive integer greater than 1; and an LED driving module configured to control sequential driving of first to $n^{th}$ light emitting cell groups according to a voltage level of the rectified voltage, wherein:

the rectification unit is configured to supply a rectified voltage to the LED light emitting module through full-wave rectification of an AC voltage from the AC power source;

the LED light emitting module is configured to emit light upon receiving the rectified voltage from the rectification unit; and the first to $n^{th}$ light emitting cell groups respectively comprise first to $n^{th}$ light emitting cells from the m multi-cell LEDs, the first to $n^{th}$ light emitting cell groups respectively comprising the m light emitting cells therein being connected to each other in series to the LED driving module.

2. The LED lighting apparatus according to claim 1, wherein the LED driving module is configured to control sequential driving of the first light emitting cell group to the $n^{th}$ light emitting cell group by controlling formation of a current path from the first light emitting cell group to the $n^{th}$ light emitting cell group according to the voltage level of the rectified voltage.

3. The LED lighting apparatus according to claim 1, wherein each of the multi-cell LEDs comprises:

first to $n^{th}$ light emitting cells electrically connected to each other;

first to $n^{th}$ terminals for anode external connection connected to anodes of the first to $n^{th}$ light emitting cells, respectively; and first to $n^{th}$ terminals for cathode external connection connected to cathodes of the first to $n^{th}$ light emitting cells, respectively.

4. The LED lighting apparatus according to claim 3, wherein the first to $n^{th}$ light emitting cells in each of the multi-cell LEDs have different sizes.

5. The LED lighting apparatus according to claim 4, wherein the sizes of the first to $n^{th}$ light emitting cells in each of the multi-cell LEDs are determined based on a power deviation rate in each sequential driving stage.

6. The LED lighting apparatus according to claim 4, wherein the sizes of the first to $n^{th}$ light emitting cells in each of the multi-cell LEDs are determined based on a light emitting duration during one cycle of the rectified voltage.

7. The LED lighting apparatus according to claim 1, wherein the LED driving module is configured to perform dimming control by adjusting a maximum voltage level of the rectified voltage to be supplied to the LED light emitting module according to a selected dimming level.

* * * * *